United States Patent [19]

Kato

[11] Patent Number: 4,545,676

[45] Date of Patent: Oct. 8, 1985

[54] CONTROLLING APPARATUS FOR PAPER-FEEDING DRIVE OPERATED BY DRIVING SYSTEM OF OPTICS UNIT FOR EXPOSURE

[75] Inventor: Shogo Kato, Hachioji, Japan

[73] Assignee: Konishiroku Photo Industry Co., Ltd., Tokyo, Japan

[21] Appl. No.: 527,169

[22] Filed: Aug. 26, 1983

[30] Foreign Application Priority Data

Aug. 27, 1982 [JP] Japan ..... 57-148757

[51] Int. Cl.[4] ..... G03G 15/00

[52] U.S. Cl. ..... 355/3 SH

[58] Field of Search ..... 355/3 SH, 8, 14 SH

[56] References Cited

U.S. PATENT DOCUMENTS

| | | | |
|---|---|---|---|
| 4,155,641 | 5/1979 | Sagara et al. | 355/8 |
| 4,349,269 | 9/1982 | Okada | 355/3 SH X |
| 4,354,759 | 10/1982 | Bujese | 355/3 SH |
| 4,428,663 | 1/1984 | Ito et al. | 355/3 SH X |

FOREIGN PATENT DOCUMENTS

| | | | |
|---|---|---|---|
| 132351 | 10/1981 | Japan | 355/8 |

*Primary Examiner*—Donald A. Griffin

*Attorney, Agent, or Firm*—Jordan B. Bierman

[57] ABSTRACT

A photocopying machine having an optical system for scanning a document to be copied, including a reciprocating portion capable of forward movement for scanning and reverse movement for recovery, which movements are produced by corresponding forward and reverse rotation of a drum. The device also contains a paper feeding drive comprising a controlling cam adapted to rotate with the drum and control the driving of a paper feeding roller to feed the recording paper. The improvement is a controlling apparatus for the paper feeding drive wherein rotation of the paper feeding roller is suspended during at least a part of the reverse movement of the reciprocating portion while a sheet of paper is being fed from the paper supply to the paper feeding drive.

9 Claims, 10 Drawing Figures

CONTROLLING APPARATUS FOR PAPER-FEEDING DRIVE OPERATED BY DRIVING SYSTEM OF OPTICS UNIT FOR EXPOSURE

BACKGROUND OF THE INVENTION

1. Field of the Invention

The present invention relates to the driving system of a copying machine and more particularly to the driving system of the optical system for the exposure that optically scans the document.

2. Description of the Prior Art

In the past, the driving and controlling of the optical system for exposure having a function of a forward and backward traveling that optically scans the document have been done through the electromagnetic clutch for the forward movement that takes charge of the forward traveling of the optics unit for exposure and the electromagnetic clutch for the backward movement that takes charge of the backward traveling of the optical system for exposure both are incorporated in the driving system extending over the driving motor and the optical system for exposure and are further controlled by signals such as a commanding signal for copying and a signal of a limit switch such as a microswitch and others.

With such a structure, however, the manufacturing cost of a copying machine tends to be comparatively high due to the introduction of an electromagnetic clutch and a relay which are expensive.

In a U.S. patent application Ser. No. 464,903 filed on Feb. 8th 1983, there is proposed a driving system of the optical system for exposure wherein no expensive electromagnetic clutch and others are used and that the paper-feeding members such as a paper-feeding roller and others may be controlled mechanically in the driving system of the optical system for exposure.

However, even in the research and development for the driving system of the optical system for exposure, there has been a fear that the recording paper for the next cycle will be conveyed to the paper-supply path by the paper-supply member during the period of copy operation in the previous cycle when the optics unit for exposure is operated again without any waiting time during the continuous copying because the paper-feeding member is kept in the driving condition until the optical system for exposure returns almost perfectly to its original position. In the aforesaid driving system of the optical system for exposure, therefore, the waiting time that means the momentary stop of the optical system for exposure is set for continuous copying thus the erroneous feeding of the recording paper is prevented. With such measures, however, the number of copies produced per certain period of time is reduced due to the setting of the waiting time thereby there is a limitation for the efficient copying.

SUMMARY OF THE INVENTION

The object of the present invention is to improve the driving system of the optics unit for exposure in aforesaid U.S. patent application Ser. No. 464,903 and to increase the number of copies produced per certain period of time.

The present invention to attain aforesaid object will be summarized as follows.

In the copying machine wherein the cam follower that controls the spring clutch incorporated in the driving system for the paper-feeding member such as a paper-feeding roller is operated by the controlling cam for the forward and backward movement that is synchronously operated by the wire drum of the optical system for exposure which scans optically the document, it is characterized that a bypass through which the cam follower can espace during the backward movement of the cam is provided and thereby the paper-feeding members are stopped at the initial state of the backward movement of aforesaid optical system for exposure.

In the past, since the paper-feeding roller was stopped synchronously with a completion of the returning of the optical system for exposure, the waiting time was needed before the restarting of the optical system for exposure for continuous copying but in the present invention, the paper-feeding roller is stopped at the initial stage of the backward movement of the optical system for exposure thereby the recording paper can be advanced up to the paper-feeding roller in advance and therefore the optical system for exposure can be operated forward and backward without any waiting time. This means that the present invention can increase the number of copies produced per certain period of time for continuous copying.

DETAILED DESCRIPTION OF THE INVENTION

Figure 1:
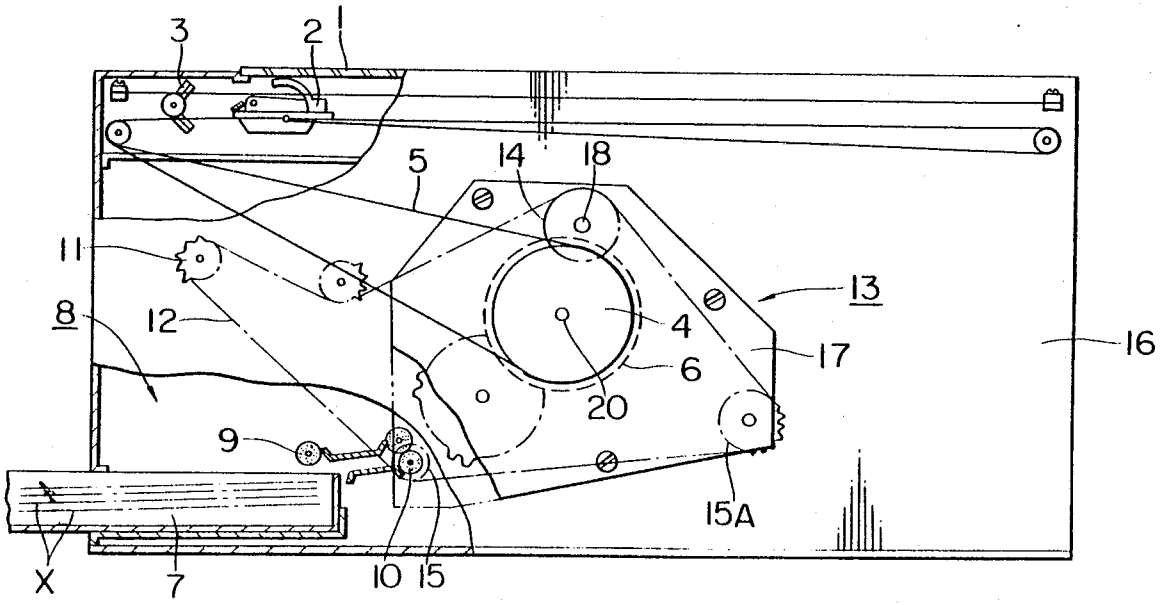
FIG. 1 is a side view of the electrophotographic copier which is partially cut open and to which the present invention is applied.

The example of the present invention will be illustrated in detail as follows referring to the drawings.

In FIG. 1, the electrophotographic copying machine to which the present invention is applied is equipped with the optical system for exposure that optically scans the surface of the document placed on a document glass plate 1. Namely, the illustrated optical system for exposure is equipped with a first movable stand 2 having an illuminating lamp and a slit plate thereon and a second movable stand 3 having 2 mirrors thereon and is driven in the direction same as that of the first movable stand 2 and these movable stands 2 and 3 are moved forward and backward by a driving wire 5 driven by a wire drum 4 thus the image of the document is formed on the circumferential surface of a photoreceptor drum 6 shown with a dotted line.

Further, the illustrated electrophotographic copying machine has a paper-feeding device 8 that feeds recording papers X contained in a cassette 7 against the photoreceptor drum 6 one sheet by one sheet. This paper-feeding device 8 has a paper-feeding member such as a paper-draw-out roller 9 that draws out recording papers X in the cassette 7 one sheet by one sheet and a paper-feeding roller 10 that feeds the recording paper X drawn out by the paper-draw-out roller 9 to the photoreceptor drum 6 in pertinent timing. And the driving chain 12 that transmits the driving power to aforesaid wire drum 4 and to the paper-feeding roller 10 is hung over a driving sprocket 11 of the unillustrated driving motor. A driving chain 12 driven in the direction of an arrow A in FIG. 2 is hung over an input sprocket 14 of a driving system 13 that controls the wire drum 4, a relay sprocket 15A and an input sprocket 15 of the paper-feeding roller 10 in consecutive order.

Figure 2:
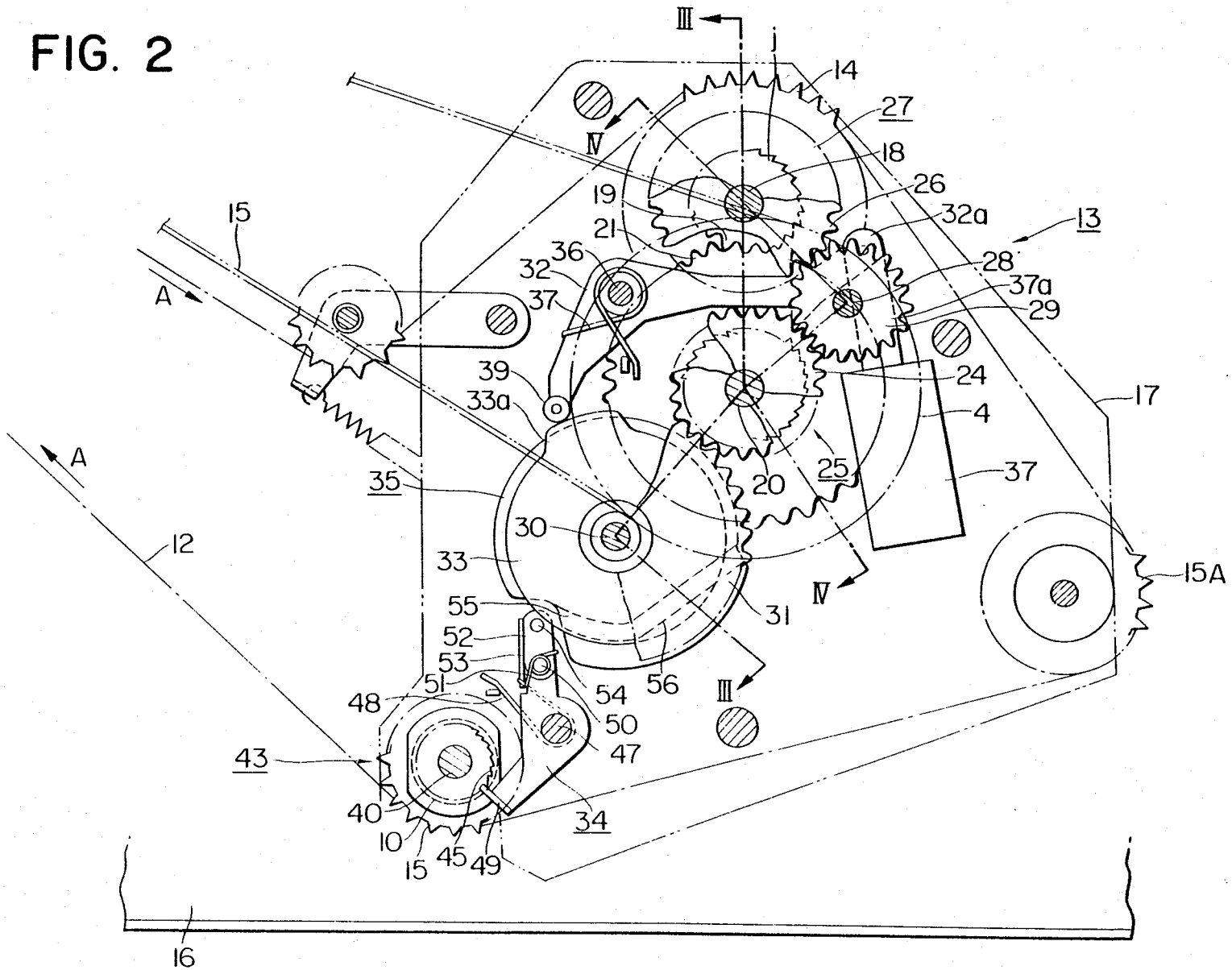
FIG. 2 is an enlarged side view of the driving system of the same copying machine from which the base board is removed.
Figure 3:
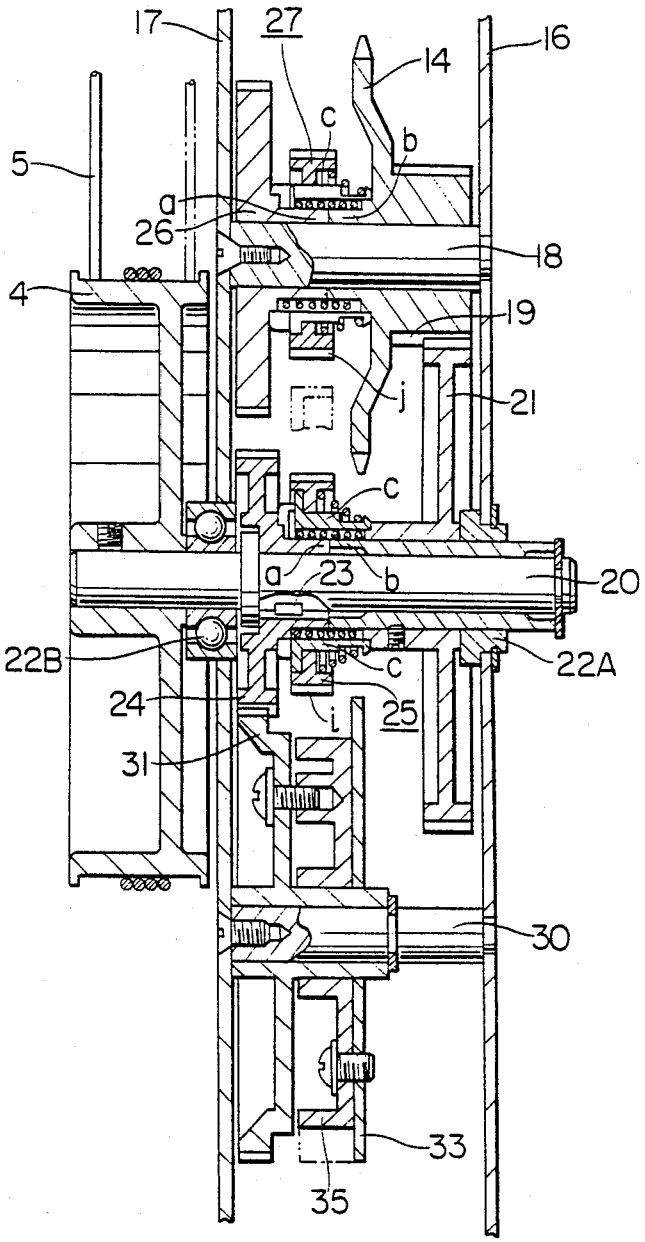
FIG. 3 is a cross-sectional view taken along the line III—III of FIG. 2.
Figure 4:
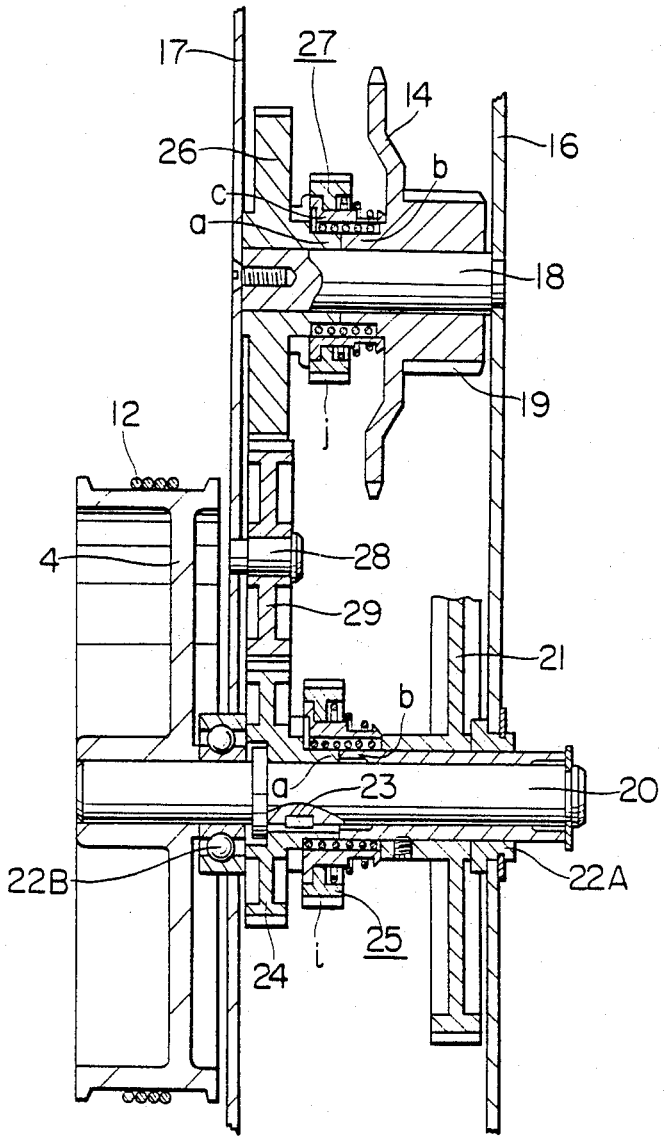
FIG. 4 is a cross-sectional view taken along the line IV—IV of FIG. 2.

FIG. 2 through FIG. 4 show the details of the drive-controlling section of aforesaid wire drum 4 and aforesaid input sprocket 14 is rotatably supported around the first supporting shaft 18 crossing over a side frame 16 of the machine body and an attaching plate 17 fixed at the distance from the side frame 16 of the machine body. The input sprocket 14 has a driving spur gear 19 being united with the sprocket 14 and this driving spur gear 19 is meshed with a reduction gear 21 with a large diameter supported rotatably around a drum shaft 20 as shown in FIG. 3. The drum shaft 20 having the wire drum 4 fixed on one end thereof is axially supported through bearings 22A and 22B between the side frame 16 of the machine body and the attaching plate 17 and on the circumferential surface of the drum shaft 20 adjoining to aforesaid reduction gear 21, the driven gear 24 fixed to the drum shaft 20 through a key 23 is settled and between the boss a of a driven gear 24 and the boss b of aforesaid reduction gear 21, there is arranged a first spring clutch 25 (the details of the first spring clutch will be described later referring to FIG. 5) which transmits selectively the movements of the reduction gear 21 to the driven gear 24. Therefore, the first driving system that gives the regular rotation to the wire drum 4 is composed of aforesaid input sprocket 14, the driving spur gear 19, the reduction gear 21 and the driven gear 24.

On the aforesaid first supporting shaft 18, on the other hand, an intermediate gear 26 is rotatably supported at the location adjoining to aforesaid input sprocket 14 and between the boss a of the intermediate gear 26 and the boss b of the input sprocket 14, there is arranged second spring clutch 27. And a reverse gear 29 supported on second supporting shaft 28 on the attaching plate 17 is meshed with the intermediate gear 26 as shown in FIG. 4 and this reverse gear 29 is constantly meshed with aforesaid driven gear 24. Therefore, the second driving system that gives the reverse rotation to the wire drum 4 is composed of the input sprocket 14 the intermediate gear 26, the reverse gear 29 and the driven gear 24 and the reverse movement is transmitted from the second driving system to the wire drum 4 when the external force is given to the sleeve C of the second spring clutch 27.

Further, between the side frame 16 of the machine body and the attached plate 17, third supporting shaft 30 is provided and around this third supporting shaft 30, a cam-driving gear 31 that meshes with aforesaid driven gear 24 and is synchronously rotated by the wire drum 4 is supported rotatably. On this cam-driving gear 31, both stopping flat cam 33 that stops the wire drum 4 by actuating an action lever 32 described later and controlling groove cam 35 that gives the rotating force to aforesaid paper-feeding roller 10 by actuating a cam follower 34 described later are arranged as one body.

Figure 5:
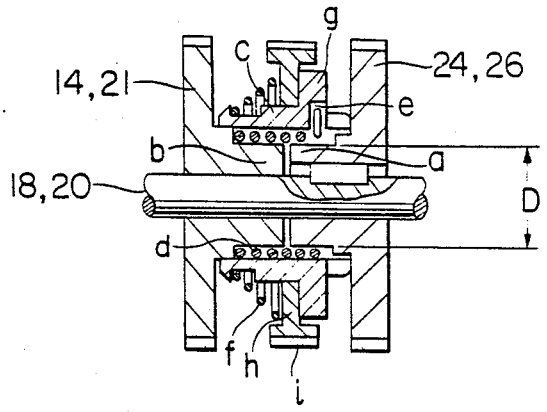
FIG. 5 is a sectional view of the internal structure of the first spring clutch and the second spring clutch.

FIG. 5 is an illustrative diagram for the structure of the aforesaid first and second spring clutches 25 and 27, and on the circumferential surface of the boss b of the gear on the driving side (e.g. input sprocket 14, reduction gear 21), one end of the coil spring d is wound tightly and thereby the coil spring d is arranged so that it can rotate together with said boss b as one body. And the outside diameter D of the boss a of the gear on the driven side (e.g. intermediate gear 26, driven gear 24) around which the other end of the coil spring d is wound is smaller than the inside diameter of the coil spring d. And the end portion of the coil spring d on the side of the boss a drops in the notch e in the direction of radius formed on the sleeve c. Therefore, if the load torque is applied on the sleeve c, the diameter of coil spring d is lessened owing to the rotating torque of the boss b and thereby the coil spring d winds around the circumferential surface of the boss a and thus the rotation of the gear on the driving side may be transmitted to the gear on the driven side. In order to give the load torque to the sleeve c, there is provided an action ring h pressed against the flange g of the sleeve c by the conical spring f and an action lever 32 whose details are shown in FIG. 2 and FIG. 7 is engaged with a ratchet i on the circumferential surface of the action ring h.

Figure 7:
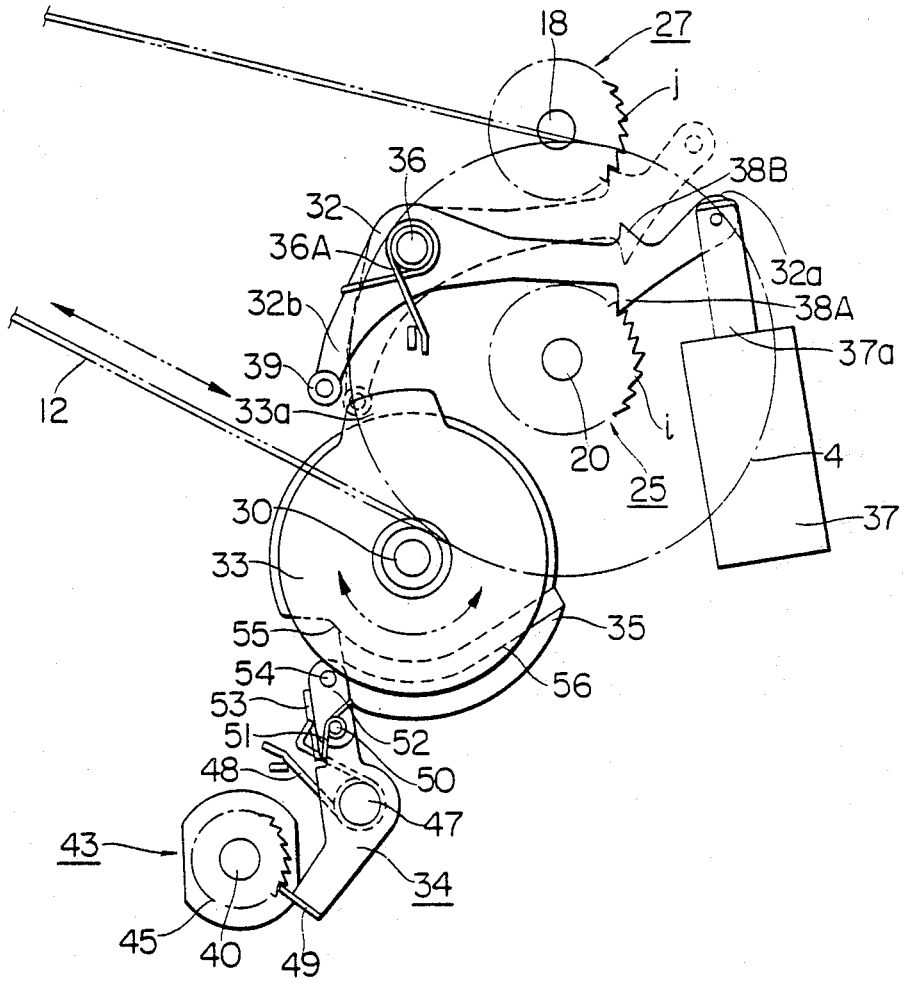
FIG. 7 is an illustrative diagram for the movements of the driving system.

The action lever 32 supported rotatably at its middle portion around fourth supporting shaft 36 shown in FIG. 2 and FIG. 7 is energized by a spring 36A counterclockwise in FIG. 7. On the one end 32*a* of the action lever 32, a plunger 37*a* of an electromagnetic solenoid 37 excited by the signal of command for copying is linked. On both sides at the middle section between the end portion 32*a* of the action lever 32 and aforesaid fourth supporting shaft 36, first deterring claw 38A that engages with a (ratchet) tooth i of the first spring clutch 25 and second deterring claw 38B that engages with a ratchet tooth j of the second spring clutch 27 are protruded and a driven roller 39 on the other end portion 32*b* of the action lever 32 is pressed against the circumferential surface of the stopping flat cam 33 by the spring 36A. When the electromagnetic solenoid 37 is excited, therefore, the first deterring claw 38A of the action lever 32 engages with the ratchet tooth i of the first spring clutch 25 as shown with a solid line in FIG. 7 and the driving power of the driving chain 12 is transmitted to the sprocket 14 and the reduction gear 21 and thereby the wire drum 4 is given a regular rotation thus the optical system for exposure travels forward. After the completion of the optical scanning of a document, the electromagnetic solenoid 37 is demagnetized and therefore the action lever 32 is moved by the spring 36A to the position shown with the dotted line in FIG. 7 and the driving power of the driving chain 12 is transmitted to the sprocket 14, the second spring clutch 27, the intermediate gear 26, the reverse gear 29 and then to the driven gear 24 and thereby the wire drum 4 is rotated reversely thus the optical system for exposure travels backward. After this, when the optics unit for exposure returns to its original position, the protrusion 33*a* of the stopping flat cam 33 hits the driven roller 39 thereby the action lever 32 is rotated clockwise against the spring 36A to be in the neutral position shown in FIG. 2 and thus the rotation of the wire drum 4 is stopped.

Figure 6:
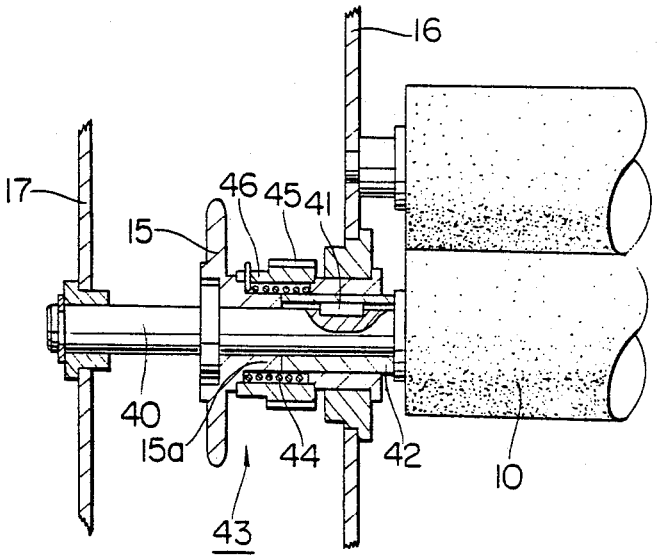
FIG. 6 is a sectional view of a paper-feeding roller driving section.

The driving section of the paper-feeding roller 10, on the other hand, is constituted as shown in FIG. 6. Namely, around a roller shaft 40 which is one with the paper-feeding roller 10, aforesaid input sprocket 15 is supported rotatably and between the boss 15*a* of the input sprocket 15 and a driven tube 42 fixed to the roller shaft 40 through a key 41, there is provided third spring clutch 43. This spring clutch 43 comprises aforesaid boss 15*a*, a coil spring 44 would around the driven tube 42 and a sleeve 46 having one end of the coil spring 44 inserted therein and ratchet teeth 45 formed on the peripheral surface thereof. On the spring clutch 43, therefore, when the ratchet tooth 45 is deterred, the slipping is generated between the coil spring 44 and the boss 15*a* and thereby the rotation of the input sprocket 15 is not transmitted to the roller shaft 40.

Figure 8:
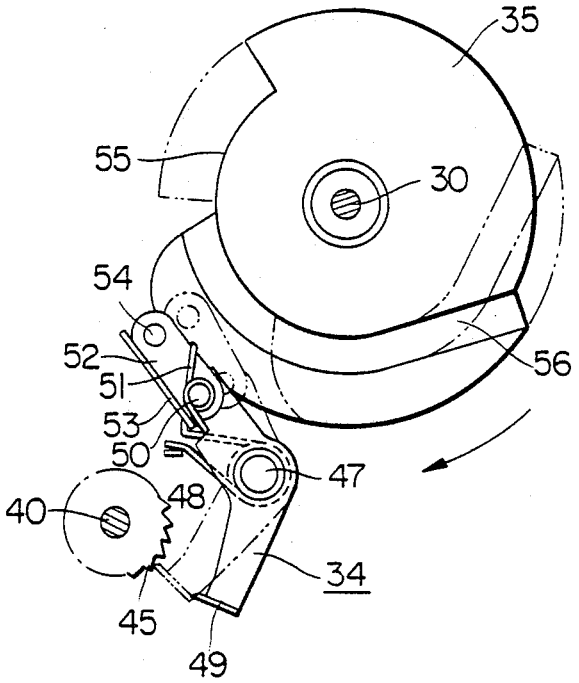
FIG. 8 and FIG. 9 are an illustrative diagram for the movements of the cam follower for the forward movement and the backward movement of the optical system for exposure and FIG. 10 is a time chart for the present invention which is compared with the conventional case.
Figure 9:
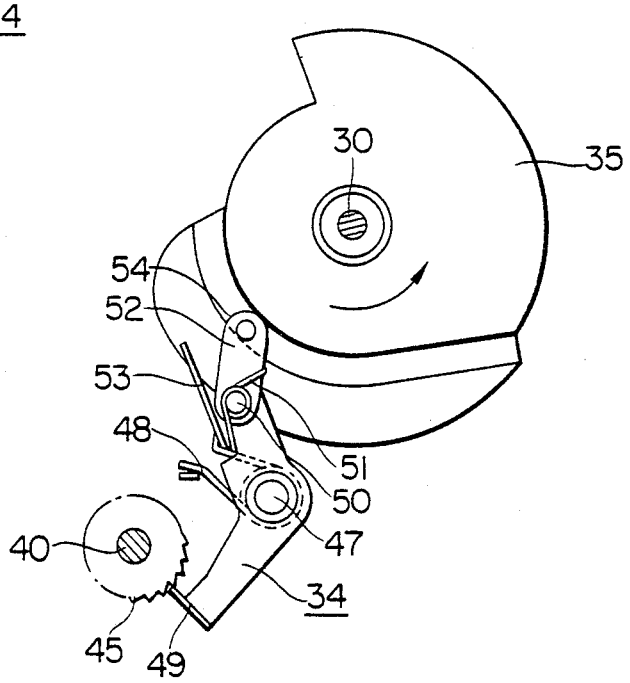

Between the aforesaid controlling cam 35 and the sleeve 46 of aforesaid spring clutch 43, aforesaid cam follower 34 whose details are shown in FIG. 7–FIG. 9 is provided. This cam follower 34 is supported rotatably at its middle area around fifth supporting shaft 47 and it is energized clockwise by a spring 48. A deterring claw 49 on one end of the cam follower 34 engages with the tooth 45 of aforesaid sleeve 46 and therefore, when no restriction is given to the cam follower 34, the rotation of the sleeve 46 of the third spring clutch 43 is deterred by the deterring claw 49 thus the paper-feeding roller 10 is stopped. On a supporting shaft 50 on the other end of the cam follower 34, on the other hand, a swiveling member 52 energized counterclockwise by the spring 51 is supported and this sweveling member 52 is rested against a stopper 53 that is formed by bending a part of the cam follower 34.

On the tip of aforesaid swiveling member 52, on the other hand, a driven pin 54 that contacts aforesaid controlling cam 35 is fixed. The controlling cam 35 has a notch 55 in which the driven pin 54 drops when the optics unit for exposure is located in its initial position and an arrangement is made so that the paper-feeding roller 10 is stopped when the driven pin 54 is located at the position whose radius around the third supporting shaft is mostly the same as that of the notch 55 and on the surface of the controlling cam 35, there is formed a bypass groove 56 in which the driven pin 54 drops only when the controlling cam 35 rotates backward. Therefore, for the forward movement (this corresponds to the forward movement of the optics unit for exposure) of the controlling cam 35 shown in FIG. 8, the driven pin 54 contacts the top portion of the controlling cam 35 and thereby the deterring claw 49 comes off the ratchet tooth 45 and thus the paper-feeding roller 10 rotates. For the backward movement (this corresponds to the backward movement of the optical system for exposure) of the controlling cam shown in FIG. 9 on the other hand, the driven pin 54 enters the bypass groove 56 at the beginning of the backward movement and the deterring claw 49 engages with a ratchet tooth 45 and thus the paper-feeding roller 10 is stopped.

Since the apparatus of aforesaid example has the constitution mentioned above, each member takes its position shown in FIG. 2 before the start of copying. Namely, the driven roller 39 of the action lever 32 engages with the protrusion 33*a* of the stopping cam 33 and the action lever 32 is in the neutral position shown in FIG. 2 and therefore, the first and second spring clutches 25 and 27 do not operate and no power is transmitted to the wire drum 4 from the first driving system as well as from the second driving system thus the movable stands 2 and 3 of the optics unit for exposure stay at the initial position. Further, the driven pin 54 of the cam follower 34 is in the notch 55 of the controlling cam 35 and therefore, the deterring claw 49 of the cam follower 34 engages with a ratchet tooth 45 of the spring clutch 43 and thereby the spring clutch 43 is kept in the non-operation condition thus the paper-feeding roller 10 is suspended.

After this, the signal of the command for copying (this signal may last for the period of time corresponding to the dimension of the document) is given from the main body of the copying machine and the electromagnetic solenoid 37 is excited by the signal of the command for copying, the action lever 32 is moved to the position shown with a solid line in FIG. 7, the deterring claw 38A of the action lever 32 engages with a ratchet tooth i of the first spring clutch 25 and the rotation of the action ring h is stopped. Consequently, the sleeve c of the first spring clutch 25 receives a load torque from the action ring h, the coil spring d is reduced in its diameter, the power is transmitted from the reduction gear 21 to the driven gear 24, the wire drum 4 is given a regular rotation, the forward movement of the optical system for exposure is started and the optical scanning of the document is made.

Concurrently with this, the cam-driving gear 31 that meshes with the driven gear 24 starts rotating synchronously with the wire drum 4 and therefore the driven pin 54 of the cam follower 34 engages with the top portion of the controlling cam 35 in good timing for the aforesaid optical scanning and thereby the deterring claw 49 comes off a ratchet tooth 45 of the spring clutch 43 thus the rotation of the input sprocket 15 is transmitted to the roller shaft 40. Consequently, the recording paper X is fed to the photoreceptor drum 6 and copied images are transferred to the recording paper X.

After the completion of the optical scanning for the document in the aforesaid manner, the signal of the command for copying is stopped and the electromagnetic solenoid 37 is demagnetized. Thereby the action lever 32 is moved to the position shown with a dotted line in FIG. 7 by the force of the spring 36A, the deterring claw 38B of the action lever 32 engages with a ratchet tooth j, the second spring clutch 27 operates and the rotation of the input sprocket 14 is transmitted to the wire drum 4 through the intermediate gear 26, the reverse gear 29 and the driven gear 24. Consequently, the wire drum 4 is rotated reversely and the optical system for exposure is moved backward at the increased speed.

In the initial stage of the backward movement of the optical system for exposure, the driven pin 54 of the cam follower 34 enters the bypass groove 56 of the controlling cam 35 and thereby the deterring claw 49 engages with a ratchet tooth 45 and the paper-feeding roller 10 is stopped in the early stage. Consequently, the recording paper for the next cycle is fed by the paper-draw-out roller 9 up to the paper-feeding roller 10, which means a preparation for the next cycle of copying.

After this, when the optical system for exposure returns mostly to its original position, the driven roller 39 of the action lever 32 is brought to the position of the protrusion 33*a* of the stopping flat cam 33 and thereby the wire drum 4 is stopped.

Incidentally, in the aforesaid example, the optical system for exposure with a fixed platen is illustrated but it is apparent that the present invention may also be applied to the optical system for exposure with a movable platen.

Figure 10:
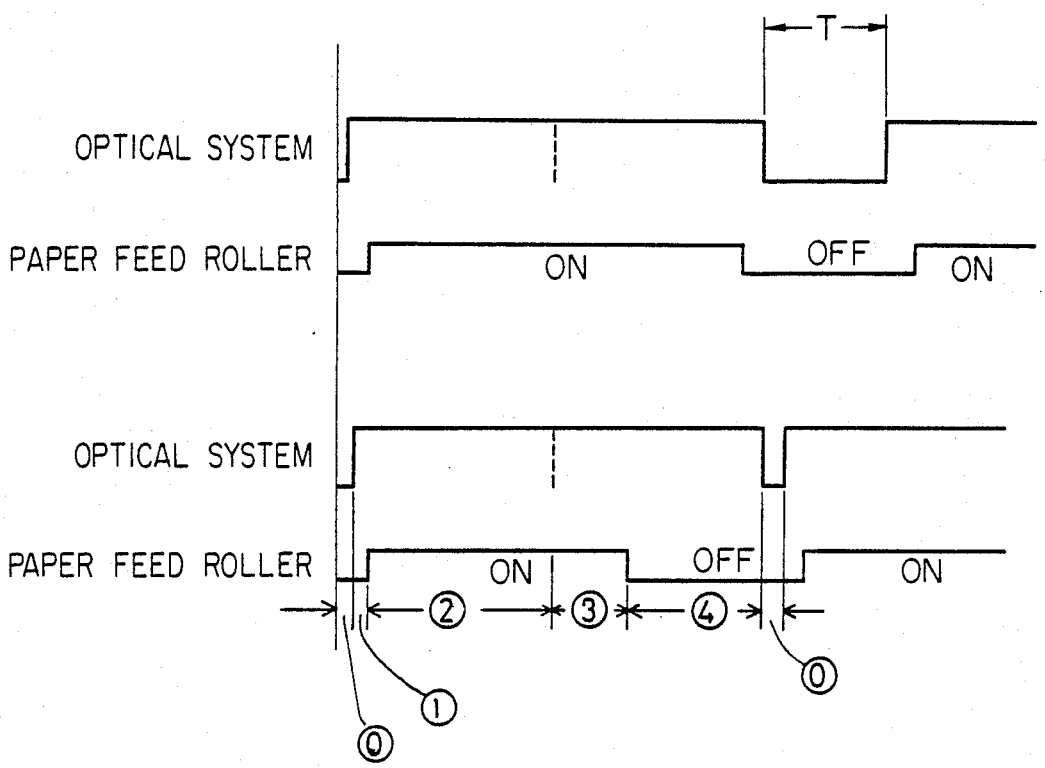

As is obvious from aforesaid illustration, the optical system for exposure may be moved forward and backward without any waiting time for continuous copying in the present invention and therefore it is possible to increase the number of copies produced per certain period of time. In the concrete illustration on this point referring to FIG. 10, (a) and (b) in FIG. 10 represent the time charts for the optical system for exposure and the paper-feeding roller in the conventional copying machine and charts (c) and (d) represent the time chart for the present invention. As is apparent from the comparison between both charts, there has been required a waiting time T before the optical system for exposure starts again for the forward movement for continuous copying because the paper-feeding roller has been stopped concurrently with the returning of the optical system for exposure in the past. In the present invention, however, the paper-feeding roller is stopped in the early stage of the backward movement of the optical system for exposure and therefore it is possible to feed in the recording paper up to the paper-feeding roller in advance and aforesaid waiting time T is not needed. This means that the number of copies produced per certain period of time may be increased for continuous copying in the present invention. In FIG. 10, the marks ⓪, ①, ②, ③ and ④ represent the conditions of FIG. 2, FIG. 7, the solid line in FIG. 8, the dotted line in FIG. 8 and FIG. 9 respectively.

What is claimed is:

1. In a photocopying machine having an optical system for scanning a document to be copied, said system including a reciprocating portion capable of forward movement for scanning said document and reverse movement for recovery, said movements being produced by corresponding forward and reverse rotation of a drum, a paper-feeding drive comprising a controlling cam adopted to rotate with said drum and controlling the driving of a paper-feeding roller to feed recording paper, the improvement which comprises a controlling apparatus for said paper-feeding drive wherein rotation of said paper-feeding roller is suspended during at least a part of said reverse movement of said reciprocating portion, a sheet of paper being fed from a supply thereof to said paper-feeding drive while said rotation of said roller is suspended.

2. The machine according to claim 1 wherein said controlling apparatus is operated by the driving means for said optical system.

3. The machine according to claim 1 wherein said optical system, said paper-feeding drive, and said controlling apparatus are mechanically linked to said drum, whereby rotation of said drum operates said optical system and said control apparatus.

4. The machine according to claim 3 wherein said controlling apparatus includes a clutch between said paper-feeding roller and the source of power, said controlling cam having a first portion which urges a cam follower so as to cause said clutch to connect said roller with said source, said controlling cam also having a second portion which urges said cam follower so as to cause said clutch to disconnect said roller from said source, said cam follower being guided along said first portion during movement of said controlling cam corresponding to said forward movement of said reciprocating portion and said cam follower being guided along said second portion during movement of said controlling cam corresponding to said reverse movement of said reciprocating portion.

5. The machine according to claim 1 wherein said suspension is caused by reverse movement of said controlling cam.

6. The machine according to claim 1 wherein said controlling cam comprises a first cam which controls the forward and reverse movements of said reciprocating portion and a second cam which controls the rotation and suspension of said paper-feeding roller.

7. The machine according to claim 1 wherein a cam follower contacts the external peripheral surface of said second cam for forward movement of said reciprocating portion and one end of the cam follower contacts a side wall of a groove cam provided inside said external peripheral surface for the reverse movement thereof.

8. The machine according to claim 7 wherein said paper-feeding drive comprises a first clutch having ratchet teeth, a first detent claw on said cam follower, said claw adapted to engage at least one of said ratchet teeth, whereby rotation of said paper-feeding roller is suspended.

9. The machine according to claim 8 wherein said detent claw is on one end of said cam follower and is adapted to engage with or disengage from said ratchet teeth, the other end of said cam follower having a rotatable swivelable member urged against a stopper, whereby the surface of said second cam is contacted thereby.

* * * * *